US006158921A

United States Patent [19]

Holmes

[11] Patent Number: 6,158,921

[45] Date of Patent: Dec. 12, 2000

[54] SCREED EXTENSION WITH INDEPENDENTLY ADJUSTABLE ANGLE OF ATTACK

[75] Inventor: Ted E. Holmes, Mattoon, Ill.

[73] Assignee: Blaw-Knox Construction Equipment Corporation, Mattoon, Ill.

[21] Appl. No.: 09/363,927

[22] Filed: Jul. 30, 1999

Related U.S. Application Data

[60] Provisional application No. 60/094,762, Jul. 31, 1998.

[51] Int. Cl.[7] ..... E01C 19/22

[52] U.S. Cl. ..... 404/104; 404/118

[58] Field of Search ..... 404/96, 104, 118, 404/119, 120

[56] References Cited

U.S. PATENT DOCUMENTS 5,924,819 7/1999 Breidenbach ..... 404/96

*Primary Examiner*—Eileen D. Lillis
*Assistant Examiner*—Gary S. Hartmann
*Attorney, Agent, or Firm*—Mark A. Ussai

[57] ABSTRACT

A screed assembly for use in paving material upon a generally horizontal surface includes a main screed having a generally vertical front surface. At least one and preferably two screed extensions are connected with the main screed. At least one and preferably a pair horizontally-extending support members each have a first end movably connected with the main screed and a second end connected with a screed extension. The support members are movable with respect to the main screed so as to displace the screed extensions alternately toward and away from the main screed front surface so as to adjust the angle of attack of the screed extensions independently of the angle of attack of the main screed. Preferably, an adjustment assembly or device is connected with the support member and is configured to displace the support member with respect to the main screed. The adjustment device includes a base attached to either the main screed or the support member, preferably the support member. A horizontally-extending rod has a first end attached to the other of the main screed or the support member and a second end movably engaged with the base. Movement of the rod with respect to the base displaces the screed extension alternatively toward and away from the front surface of the main screed so as to adjust the angle of attack of the screed extension.

20 Claims, 5 Drawing Sheets

SCREED EXTENSION WITH INDEPENDENTLY ADJUSTABLE ANGLE OF ATTACK

This application claims the benefit of U.S. Provisional Application Ser. No. 60/094,762, filed Jul. 31, 1998.

BACKGROUND OF THE INVENTION

The present invention relates to paving screed assemblies, and more particularly to paving screeds with screed extensions.

Screed assemblies 1 used with paving machines to level paving material, typically asphalt, applied by the machine onto a generally horizontal base surface 2 are well known, an example of such being depicted in FIGS. 1 and 2. Such screed assemblies 1 often include both a main screed 3 and one or more pairs of screed extensions 4 connected with the main screed 3. The screed extension 4 may either be fixedly attached (e.g., bolted) to an end of the main screed 3 (or an outer end of another screed extension 4) or movably attached to the main screed 3. Movably attached screed extensions 4 are commonly referred to as "extendible screeds" and are laterally displaceable with respect to the main screed 3, typically by means of hydraulic cylinders (not shown) so as to either be extended outwardly beyond the outer ends 3*b* of the main screed 3 or retracted into centralized positions. Both types of screed extensions 4 enable the screed assembly 1 to be adjusted for use in paving different base surfaces 2 of various widths.

Typically, the extendible screeds 4 are attached to the main screed 3 such that the screed extension 4 is disposed either frontwardly or rearwardly of the main screed 3, and move along the front or rear vertical surface, respectively, of the main screed 3. As shown in FIG. 2 for a "front-mounted" screed extension 4, each screed extension 4 is typically connected to the main screed 3 so as to be vertically suspended from a pair of laterally spaced support members 6. With this construction, the screed extensions 4 are only prevented from swinging or pivoting about the support members 6 due to the fact that a "floating" screed assembly 1 is generally tilted rearwardly, such that the rear vertical surface 4*b* of the screed extension rests against (and is thus supported by) the front surface 3*b* of the main screed 3. As the screed assembly 1 moves forwardly during a paving operation, contact with the paving material also tends to "push" the screed extensions 4 rearwardly into contact with the main screed 3. As the screed extensions 4 are connected to and supported by the main screed 3, the screed extensions 4 essentially follow or "mimic" the movement of the main screed 3. Thus, when the main screed 3 is rotated about a longitudinal or laterally-extending axis 1*b* of the screed assembly 1 (FIG. 1) in order to adjust the assembly 1 angle of attack $\alpha$ (as described below), the screed extension 4 rotates with the main screed 3.

In order to control the depth of the finished "mat" of paving material, the "angle of attack" $\alpha$ of the screed assembly 1 (FIG. 2) may have to be adjusted. The main screed 3 is "tilted" forwardly or rearwardly about axis 1*b* to position the main screed working surface 3*a* at the desired angle of attack $\alpha$. Due to the rotation of the main screed 3 to the desired angle $\alpha$, the screed extensions 4 also rotate so as to be positioned at substantially the same angle of attack $\alpha$. In certain paving projects, it has been determined that having a lesser angle of attack $\alpha$ at the outer edges of the screed assembly 1, i.e., the areas leveled by the screed extensions 4, favorably modifies the "flow" of paving material such that a better finished mat of material is produced. However, with known screed assemblies 1 as described above, the screed extensions 4 are merely adjustable vertically with respect to the main screed 3 in order to position the extension working surface 4*a* at substantially the same height as the main screed working surface 3*a*. With such screed assemblies 1, the screed extensions 4 are substantially prevented from being angled or tilted with respect to the main screed 3 due to the above-described abutting relation between the rear surface 4*b* and the front surface 3*b* of the screed extension 4 and the main screed 3, respectively.

Therefore, it is desirable to provide a screed assembly with screed extensions 4 having the capability of adjusting the angle of attack $\alpha$ of the screed extension working surface 4*a* relative to the working surface 3*a* of the main screed 3. Further, it is desirable to provide such an adjustment capability as a retro-fit to exiting screed assemblies.

SUMMARY OF THE INVENTION

In one aspect, the present invention is a screed assembly for use in paving material upon a generally horizontal surface. The screed assembly comprises a main screed having a generally vertical front surface and a screed extension connected with the main screed. A horizontally-extending support member has a first end connected with the main screed and a second end connected with the screed extension and is movable with respect to the main screed so as to displace the screed extension alternately toward and away from the main screed front surface.

In another aspect, the present invention is an adjustment device for varying the angle of attack of a screed assembly for paving material upon a generally horizontal surface. The screed assembly includes a main screed and a screed extension connected with the main screed. A support member has a first end connected with the main screed and a second end connected with the screed extension. The adjustment device comprises a base attached to one of the main screed and the support member. A horizontally-extending rod has a first end attached to the other of the main screed and the support member and a second end movably engaged with the base. Movement of the rod with respect to the base displaces the screed extension one of toward and away from the front surface of the main screed so as to adjust the angle of attack of the screed extension.

In a further aspect, the present invention is also a screed assembly for use in paving material upon generally horizontal surface. The screed assembly comprises a main screed having a generally vertical front surface and a screed extension connected with the main screed. A support member has a first end connected with the main screed and a second end connected with the screed extension and extends generally perpendicularly with respect to the front surface of the main screed. An adjustment assembly is connected with the support member and is configured to displace the support member with respect to the main screed so as to move the screed extension alternately toward and away from the front surface of the main screed.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
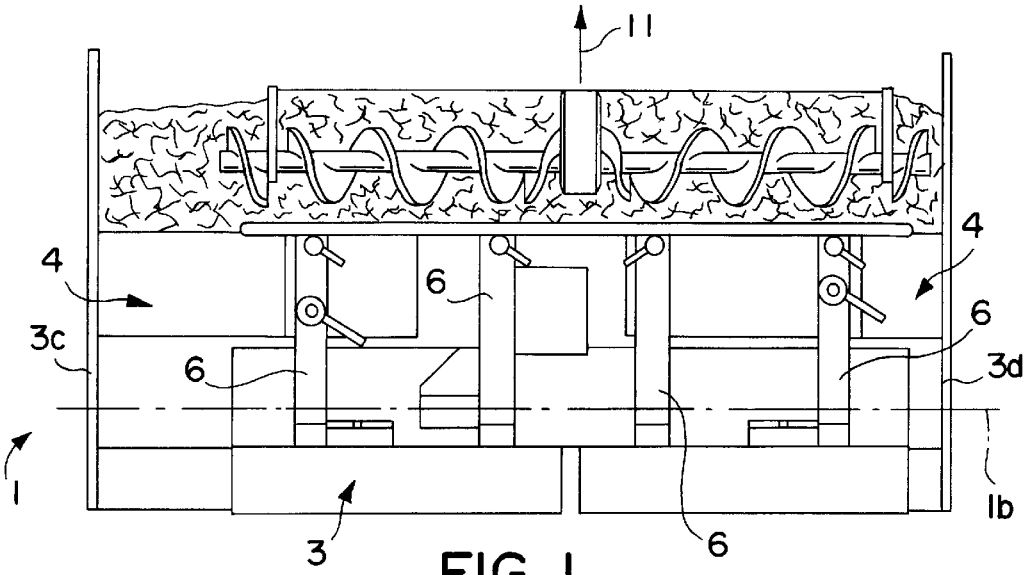
FIG. 1 PRIOR ART
FIG. 1 is a top view of a typical screed assembly having a known strike-off assembly.
Figure 2:
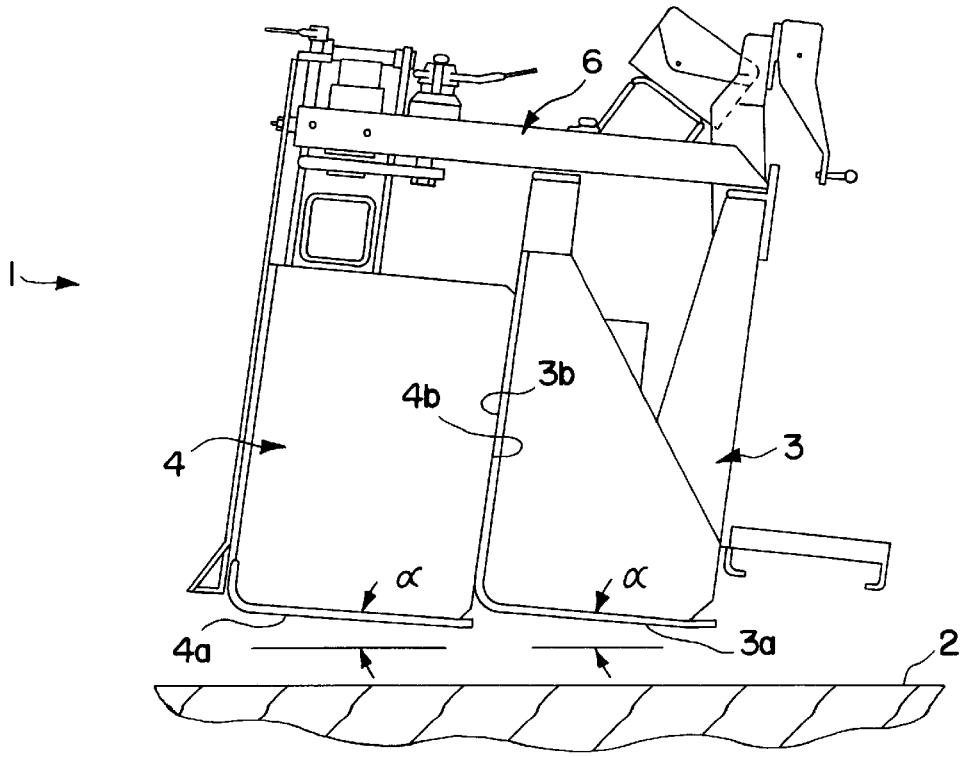
FIG. 2 PRIOR ART
FIG. 2 is a left side elevational view of the screed assembly of FIG. 1.

Certain terminology is used in the following description for convenience only and is not limiting. The words "right", left", "lower", "upper", "upward", "down" and "downward" designate directions in the drawings to which reference is made. The words "front", "frontward" and "rear", "rearward" refer to directions toward and away from, respectively, a designated front section of a screed assembly or a specific portion thereof, the particular meaning intended being readily apparent from the context of the description. The terminology includes the words specifically mentioned above, derivatives thereof, and words of similar import.

Referring now to the drawings in detail, wherein like numbers are used to indicate like elements throughout, there is shown in FIGS. 3–8 an improved screed assembly 10 for use in paving material upon a generally horizontal base surface 2 in accordance with the present invention. The screed assembly 10 primarily comprises a main screed 3 having a generally vertical front surface 3*b* and at least one and preferably two screed extensions 4 connected with the main screed 3. At least one and preferably two horizontally-extending support members 12 each have a first end 12*a* movably connected with the main screed 3 and a second end 12*b* connected with a screed extension 4. Each support member 12 is movable with respect to the main screed 3 so as to displace the connected screed extension 4 alternately toward and away from the main screed front surface 3*b*. Preferably, an adjustment assembly 14 or adjustment device 14 in accordance with the present invention is connected with each support member 12 and is configured to displace the support member 12 with respect to the main screed 3.

Figure 8:
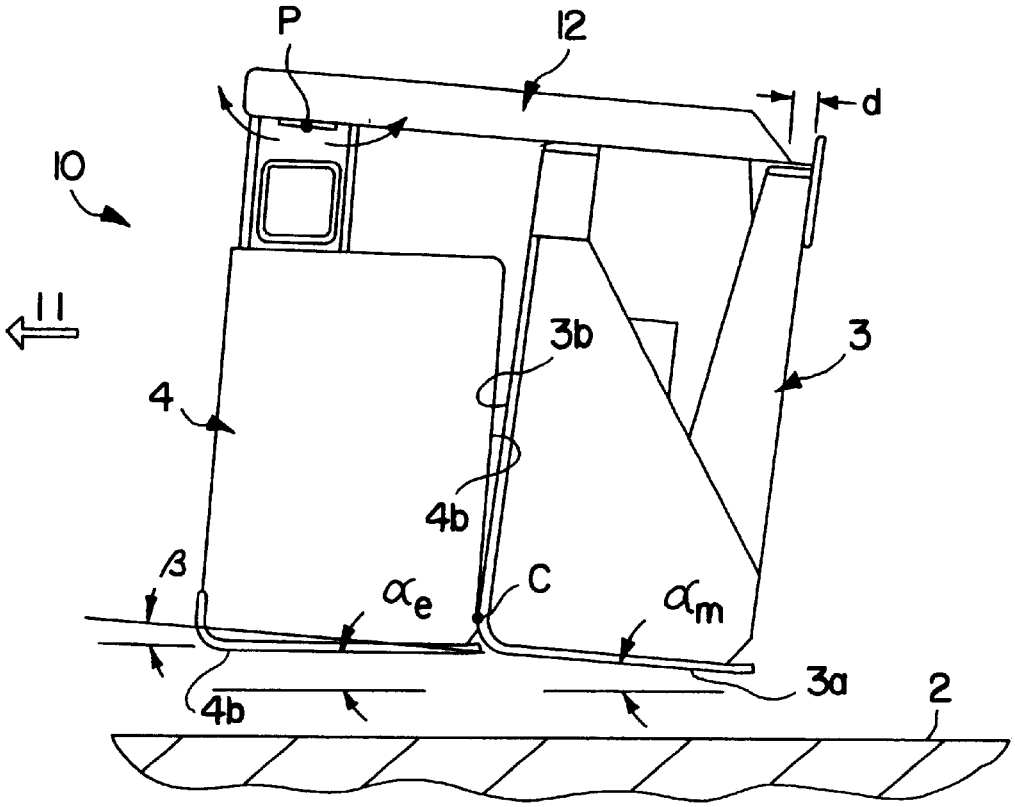
FIG. 8 is a simplified left side elevational view of the improved screed assembly, showing the screed extension at an exaggerated position displaced away from the main screed.

Referring specifically to FIG. 8, as the screed extensions 4 each have a generally horizontal working surface 4*a*, movement of the support members 12 adjusts an angle $\alpha_e$ between the screed extension working surface 4*a* and the base surface 2. Further, the main screed 3 has a generally horizontal working surface 3*a*, such that movement of the support members 12 also establishes and/or adjusts a relative angle $\beta$ between the screed extension working surface 4*a* and the main screed working surface 3*a*. Thus, the improved screed assembly 10 has the capability of adjusting the angle of attack $\alpha_e$ of each screed extension 4 independently of the angle of attack $\alpha_m$ of the main screed 3 (see FIG. 8), and also independently of the angle $\alpha_e$ of the other screed extension 4 (if desired). The above-described basic elements of the improved screed assembly 10 and the adjusting device 14 are. described in further detail below.

Referring to FIGS. 1, 2, 3 and 8, the main screed 3 and the screed extensions 4 of the improved screed assembly 10 are preferably generally similar to the corresponding devices of the known screed assembly 1 as described in the Background section of the present disclosure. Therefore, a detailed description of these components is not necessary for a complete understanding of the present invention and is beyond the scope of this disclosure, although certain details are discussed herein as follows.

As metioned above, the screed assembly 10 has two screed extensions 4, each extension 4 being disposed proximal to a separate opposing lateral end of the main screed 3. In other words, one screed extension 4 is disposed proximal to a first end and the other screed extension 4 is disposed proximal to the second end of the main screed 3, such that the two screed extensions 4 are spaced laterally along the main screed 3. Further, the screed extensions 4 are preferably configured as extendible or telescoping screed sections, such that the extensions 4 are capable of displacing laterally with respect to the main screed 3. Furthermore, the screed extensions 4 are preferably disposed forwardly/frontwardly of the main screed 3 (i.e., are "front-mounted" screed extensions), and are thus displaceable along the front vertical surface 3*b* of the main screed 3.

Figure 3:
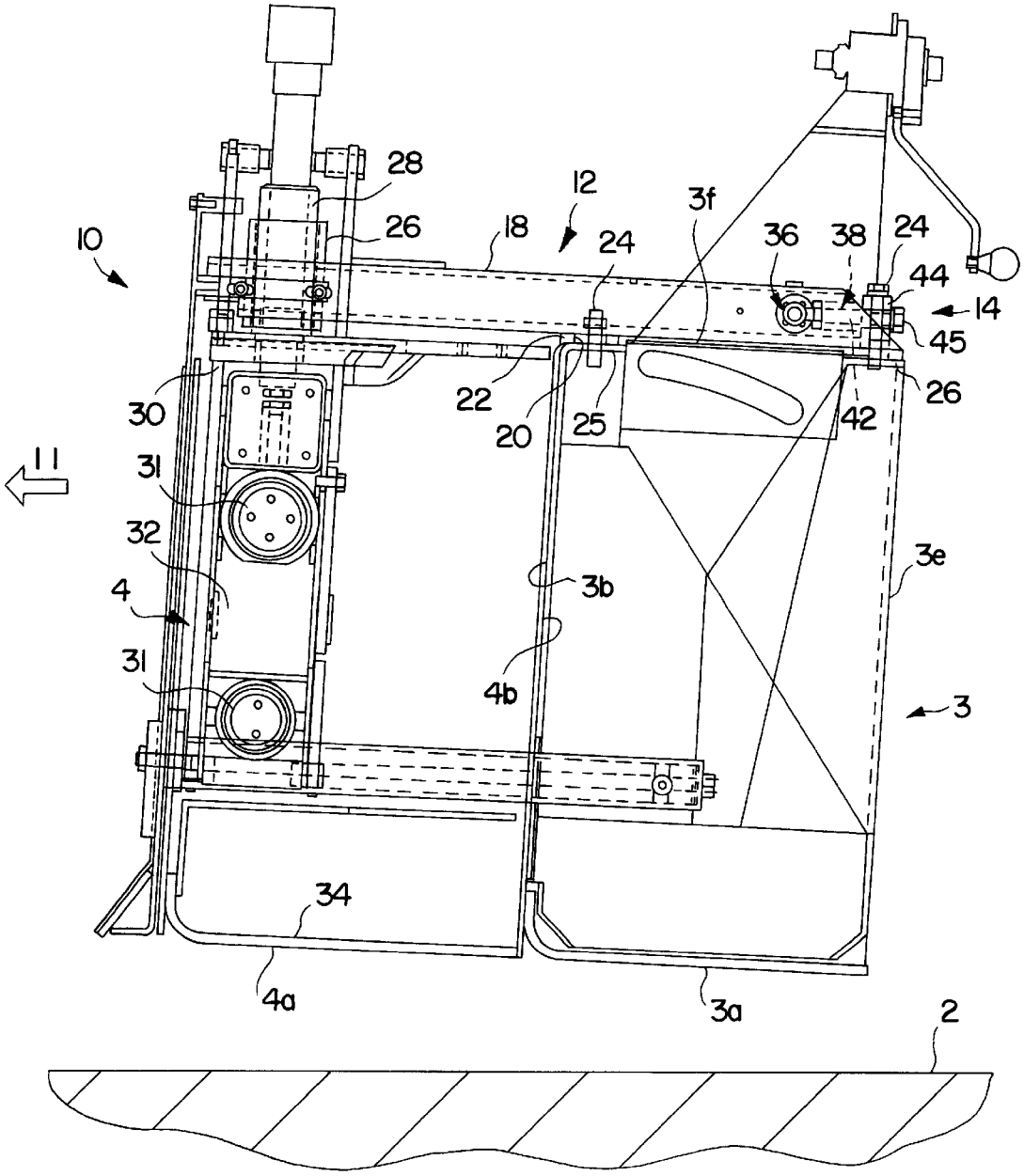
FIG. 3 is a left side elevational view of an improved screed assembly having an adjustment device in accordance with the present invention.
Figure 4:
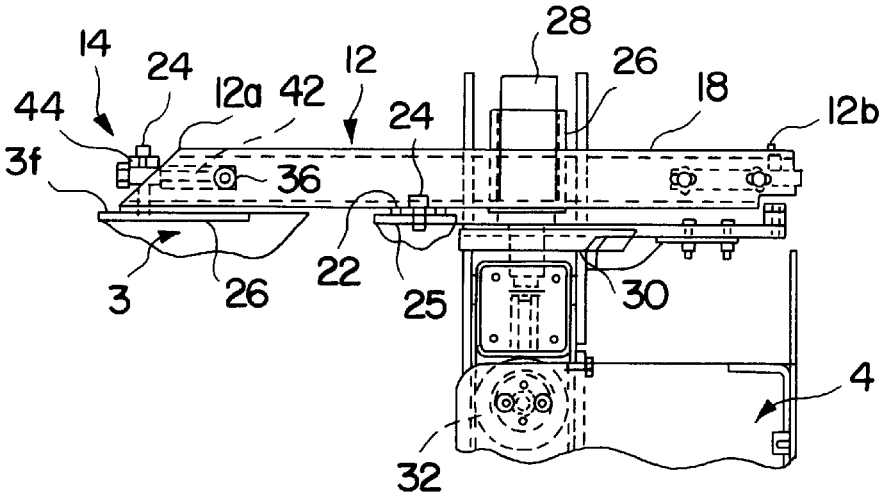
FIG. 4 is a broken-away, right side elevational view of the improved screed assembly.

Referring to FIGS. 3 and 4, the screed extensions 4 each preferably include an upper frame assembly 30, referred to as a "saddle", that is vertically adjustable with respect to the main screed 3 as discussed below. The saddle 30 includes two laterally-extending guide rails 31, on which is slidably mounted a laterally movable frame 32, and a hydraulic cylinder (not shown) configured to move the frame 32. Further, the movable frame 32 has a base plate 34, the lower surface of which provides the working surface 4*a* of the screed extension 4, such that the movable frame 32 is basically the extendible screed portion.

Although the main screed 3 and screed extensions 4 are preferably constructed as described and depicted in the present disclosure, it is within the scope of the present invention to construct the main screed 3 and/or the screed extension 4 in any other appropriate manner. For example, the screed extensions 4 may be alternatively mounted adjacent to the rear surface 3*e* of the main screed 3 (i.e., "rear-mounted" extensions), the screed assembly 10 may include only a single screed extension 4 and/or the screed extension(s) 4 may be fixedly or non-movably attached to the main screed (i.e., "bolt-on" extensions) (none depicted). Therefore, the present invention is not limited to any specific configurations of the main screed 3 and the screed extensions 4 and embraces all appropriate configurations that enable the screed assembly 10 and adjustment device 14 to function substantially as described herein.

Referring now to FIGS. 3–8, the improved screed assembly 10 preferably has two support members 12 (only one shown) movably connecting each screed extension 4 to the main screed 3, such that the screed assembly 10 includes a total of four support members 12. Alternatively, although not preferred, the screed assembly 10 may include one support member 12 for each screed extension 4 or even only a single support member 12 if the assembly has only one extension 4. Referring to FIGS. 3 and 4, the two support member 12 for the left-hand screed extension 4 (FIG. 3—only one shown) and the two support members 12 for the right-hand screed extension (FIG. 4—only one shown) are preferably constructed with certain structural differences so as to enable preferred configurations for mounting and manipulating the particular screed extension 4 (e.g., location of bushings 12). However, as these structural differences do not appreciably affect the operation of the present invention, the support members 12 are generally described herein without reference to "left-hand" or "right-hand".

Figure 5:
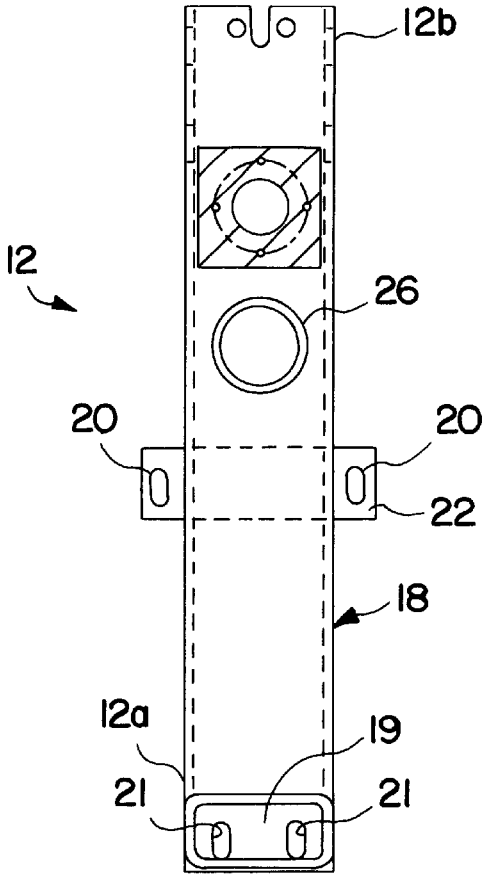
FIG. 5 is a top plan view of a support member.

Referring to FIGS. 3 and 5, preferably, each support member 12 primarily comprises a generally rectangular tubular body 18. Each tubular body 18 is preferably disposed on an upper surface 3*f* of the main screed 3 so as to extend generally horizontally along an intended direction of travel of the screed assembly 10 and generally perpendicularly with respect to the front surface 3*b* of the main screed 3. As best shown if FIG. 5, each support member 12 preferably includes a front and a rear pair of parallel slotted openings 20, 21, respectively, disposed in the tubular body 18. More specifically, the rear pair of slotted openings 21 preferably extend through the lower wall 19 of the tube 18 proximal to first end 12*a* of the support member 12. The front pair of slotted openings 20 preferably extend through a separate mounting plate 22 attached to the lower surface of the lower wall 19 near the middle of the support member 12. Preferably, all four of the slotted openings (of the two pairs 20, 21) of the support member 12 are of substantially the same length, the length being selected to enable at least a minimum desired amount of horizontal movement of the support member 12, as described below.

Figure 6:
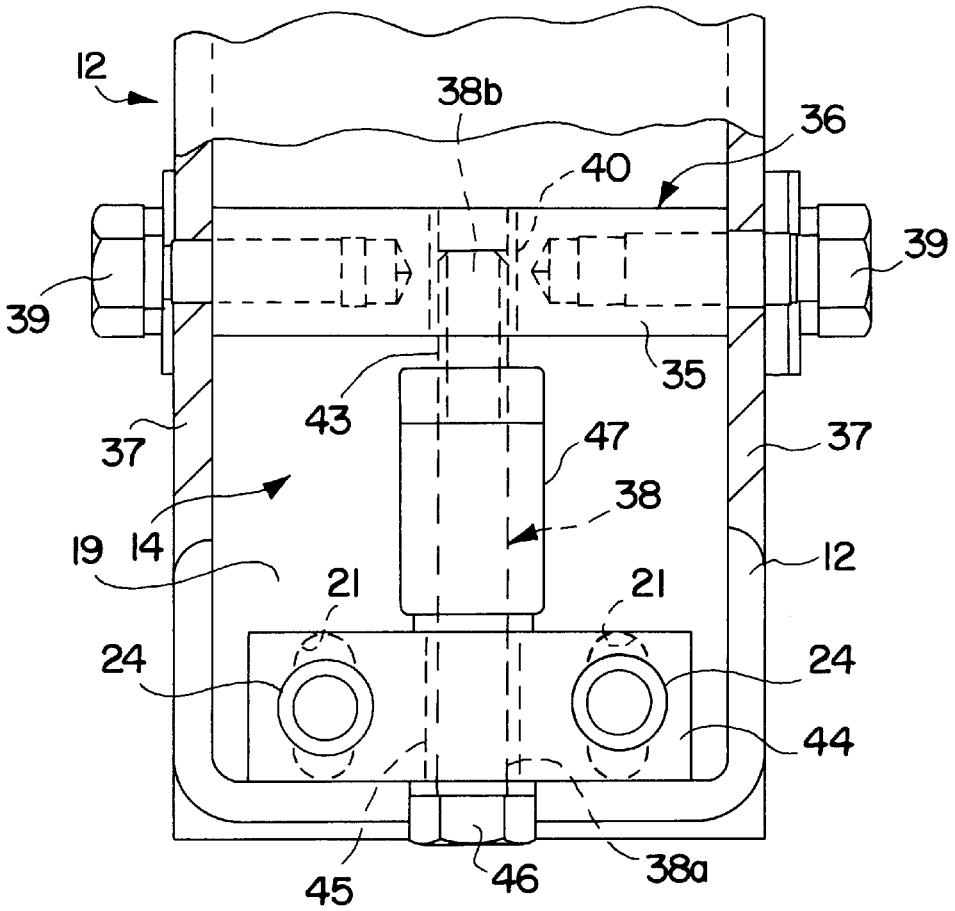
FIG. 6 is a greatly-enlarged, broken-away top plan view of the support member shown with the adjusting device connected thereto.

Referring to FIGS. 3, 4 and 6, each support member 12 is preferably securely connected with the main screed 3 by four threaded fasteners 24. More specifically, a threaded fastener 24 extends through each of the front pair of slotted openings 20 and into a front horizontal ledge 25 at the upper surface 3*f* of the main screed 3. Also, a threaded fastener 24 extends through each of the rear pair of slotted openings 21 and into a rear horizontal ledge 26 at the upper surface 3*f* of the main screed 3. Preferably, the threaded fasteners 24 secure each of the support members 12 to the main screed 3 such that there is relative movement between a support member 12 and the main screed 3 only when the angle of attack $\alpha$ of the associated screed extension 4 is being adjusted, as described below.

However, when the angle of attack $\alpha$ of the screed extension 4 is to be adjusted (as discussed below), the fasteners 24 are capable of being loosened such that the support member 12 is able to be displaced or slided horizontally frontwardly and/or rearwardly with respect to the main screed 3. By having fasteners 24 in two pairs of slots 20, 21 spaced along the intended direction of movement, the support member 12 is generally confined to moving only frontwardly and/or rearwardly and is prevented from moving laterally (i.e, toward either end 3*c*, 3*d* of the main screed 3). Further, connecting each support member 12 to the main screed 3 by using four fasteners 24 at spaced-apart locations on the tubular body 18 provides rigidity to both the support members 12 and to the attached screed extensions 4.

Referring now to FIGS. 3–5, each support member 12 preferably further includes a bushing 26 configured to engage a vertical post 28 extending upwardly from the associated screed extension 4. More specifically, the saddle 30 of each screed extension 4 includes two laterally spaced posts 28 (only one shown) that are each engaged with the bushing 26 of a separate support member 12. The engagement of the posts 28 with the bushings 26 connects the screed extension 4 to an associated pair of support members 12, and thus also with the main screed 3. With the extensions 4 being connected to the support members 12 by only two laterally-spaced, post-in-bushing connections, the mass of each screed extension 4 and the "play" or clearance between the posts 28 and the bushings 26 causes the screed extensions 4 to be pivotable frontwardly or rearwardly with respect to the support members 12 at about the points indicated as "P" in FIG. 8 (movement shown exaggerated to clarify description). The pivotal movement of the screed extensions 4 about the points P enables the angle of attack $\alpha_e$ of the screed extension 4 to be adjusted independently of the main screed 3, as discussed below.

Further, the posts 28 are adjustable within the associated bushings 26 to adjust the vertical position of the screed extension 4 with respect to the main screed 3, and thereby also adjust the height of the screed extension working surface 4*a* with respect to the main frame 3 (and also the base surface 2). More specifically, the screed assembly 10 preferably includes a ball-screw assembly (not shown) extending between each support member 12 and the associated screed extension 4. The ball-screw assemblies are configured such that rotation of the screw (not shown) causes the posts 28 to slide within the bushings 26 and thereby vertically displace the screed extension 4 with respect to the connected pair of support members 12. However, any other appropriate device/configuration for vertically displacing the screed extension 4 with respect to the associated support members 12 may alternatively be used, such as for example, hydraulic "stab" cylinders or a rack-and-pinion arrangement.

Although the above-described structure of the support members 12 is preferred, the support members 12 may be alternatively constructed in any other appropriate manner that enables the screed extensions 4 to be movably connected with the main screed 3 to provide an independently adjustable angle of attack as described above and in further detail below. For example, each support member 12 may include only the rear pair of slots 21 and fasteners 24 and have rail members (not shown) disposed forwardly of the slots 21 so as to guide the movement of the slots. Further for example, the fasteners 24 may engaged with the main screed 3 such that the fasteners 24 themselves do not prevent sliding movement of the support member 12. In the immediately previous example, a rod 42 of the preferred adjustment assembly/device 14 (described below) may be the sole means of preventing undesired sliding movement of the support member 12 or the screed assembly 10 may be provided with another appropriate device/component to retain the support member 12 at specific horizontal positions with respect to the main screed 3, such as for example, by a separate clamp or a retaining pin or pins insertable into one of series of openings (neither shown).

As yet another example, the support member 12 may be constructed of two or more movably connected portions, for example a telescoping member (not shown), such that only a portion of the support member 12 moves with respect to the main screed 3, with the other portion being attached to the frame by any appropriate means (e.g., threaded fasteners, rivets or by welding). The scope of present invention includes the above-described constructions of the support member 12 and all structures/configurations of the member 12 that are capable of movably connecting the screed extension 4 to the main screed 3 as described above and in further detail below.

Referring now to FIGS. 3, 4, 6 and 7, the adjustment assemblies 14 each primarily comprise a first member 36 or base 36 attached to either the main screed 3 or the support member 12. A second, movable member 38 has a first end 38*a* attached to the other one of the main screed 3 and the support member 12 and a second end 38*b* movably engaged with the first, base member 36. The second member 38 is displaceable with respect to the first member 36 so as to displace the support member 12 with respect to the main screed 3.

Figure 7:
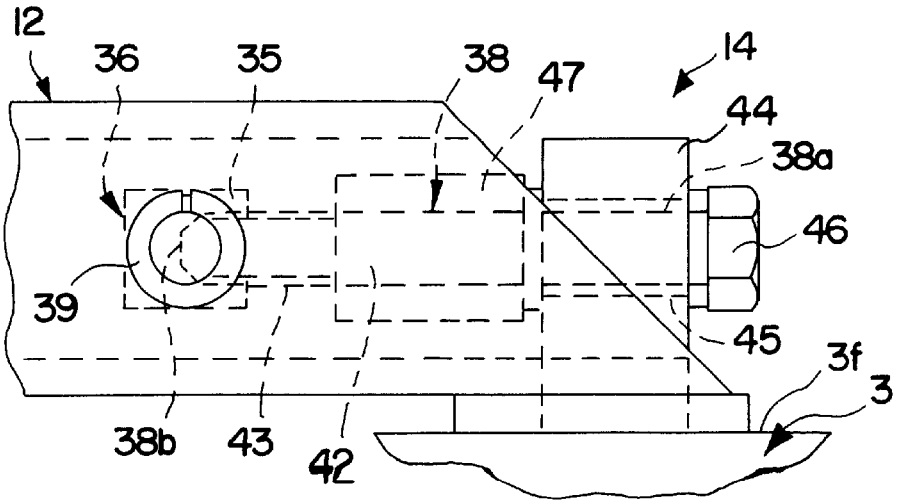
FIG. 7 is a side plan view of the section shown in FIG. 6.

Referring particularly to FIGS. 6 and 7, preferably, the first adjustment member or base 36 is a generally rectangular bar 35 disposed within the hollow interior of the tubular body 18 and extends laterally between the right and left sidewalls 37 thereof. The bar 35 is attached to the inner surfaces of the sidewalls 37 by appropriate means, preferably by threaded fasteners 39. Further, the base 36 preferably includes a threaded hole 40 for engagement with the second, movable member 38, as discussed below.

As best shown in FIGS. 6 and 7, the second adjustment member 38 is preferably configured as a rod 42 having a threaded portion 43 at the second end 38*b* that is rotatably engaged with the threaded hole 40 of the first adjustment member/base 36. The first end 38*a* of the rod 42 preferably extends through a clearance through-hole 45 in an attachment block 44 and has a head 46 at the extreme end thereof that is disposed externally of the block 44. The block 44 is attached to the main screed 3 to thereby connect the rod 42 with the main screed 3.

More specifically, the attachment block 44 is preferably disposed on the upper surface of the tubular body bottom wall 19 so as to be located above the rear pair of slots 21 of the support member 12. The above-described threaded fasteners 24 that extend through the support member rear pair of slots 21 also extend through the block 44, such that the fasteners 24 serve to both fixedly attach the rod 42 (by means of attachment block 44) to the main screed 3 and to also connect the support member 12 with the main screed 3. Preferably, each adjustment device 14 further includes a spacer block 47, through which a portion of the rod 42 extends, to limit the amount displacement of the support member 12 as discussed below.

The above-described arrangement for attaching the rod 42 to the main screed 3 is preferred as it enables both efficient use of the main screed upper surface 3*f*, specifically of the rear horizontal ledge 26, and requires less components (e.g., fasteners). In other words, if the block 44 were not disposed above a portion of the support member 12, the block 44 would have to be spaced a sufficient distance behind the end 12*a* of the support member 12 so as not to interfere with the horizontal movement of the member 12 and the block 44 would have to be attached to the screed by additional fasteners or by other means, e.g. welding. However, the present invention is not limited to having any particular arrangement or structure for attaching the second member (rod 42) to the screed 3 and includes all other appropriate elements or configurations as are apparent to a skilled artisan.

The preferred structure of the adjustment assembly/device 14 operates as follows. As described above, the second member or rod 38 is displaceable with respect to the first member or base 36 so as to displace the support member 12 (and connected screed extension 4) with respect to the main screed 3. More specifically, rotation of the rod 42, rotatably engaged with threaded hole 40 of the base member 36, causes the rod 42 to displace with respect to the base 36. The displacement of the rod 42 with respect to the base 36 causes the base 36 (and thus the attached support member 12) to displace horizontally, while the rod 42 merely rotates within the clearance hole 45 through the attachment block 44 but does not displace with respect to the main screed 3. Thus, rotation of the rod 42 causes the base 36 to travel along the threads of the rod 42, thereby pushing or pulling the support member 12 attached to the base 36 to slide upon the main screed upper surface 3*f*, while the rod 42 remains at essentially the same position with respect to the main screed 3.

More specifically, rotating the rod 42 in a first direction (e.g., counter-clockwise) causes the support member 12 to slide or displace horizontally in a frontward direction and moves the attached screed extension 4 away from the main screed 3. Further, rotation of the rod 42 in a second, opposing direction (i.e., clockwise) causes the support member to slide/displace horizontally rearward, thereby moving the screed extension 4 toward the main screed 3. Preferably, the rod 42 is rotated manually by means of a hand tool, such as a ratchet or wrench), or by a handle (not shown) attached to the head 46, or automatically by means of an appropriate device, such as for example a chain-and-sprocket drive (not shown).

Alternatively, the adjustment device 14 may be configured such that the block 44 is the first or base member and the bar 35 functions merely as an attachment device (i.e., attaches the rod 42 to the support member 12), with the rod 42 having the second end 38*a* secured to the bar 35 so as to be free to rotate therein and the first end 38*a* being threadably engaged with the block 44 (i.e., with hole 45 being a threaded hole instead of a clearance hole). In this alternative configuration, the rod 42 both rotates and displaces through the base block 44 to carry the bar 35 (and thus support member 12) as the rod 42 displaces horizontally with respect to the main screed 3.

As yet another alternative construction, the adjustment device 14 may be configured as a hydraulic jack cylinder (also called a "stab" cylinder) (not shown), with the cylinder body providing the first, base member 36 and the piston with attached rod providing the second, movable member 38. As an even further example, the first, base member 36 may be a rotatable pinion and the second, movable member 38 may be a rack gear (not shown). It is therefore within the scope of the present invention to construct the adjustment device 14 in any of the above-described configurations or in any other appropriate structure having at least two movably connected members configured to displace the support member 12 with respect to the main screed 3.

Referring now to FIGS. 3 and 8, with the preferred structure of the improved screed assembly 10, the angle of the attack $\alpha_e$ of a screed extension 4 (left extension shown) is adjustable in the following manner. First, the fasteners 24 connecting the associated pair of movable members 12 to the main screed should be loosened, if necessary, to enable displacement of the support members 12 with respect to the main screed 3. Then, the rod 42 of the adjustment device 14 connected to each support member 12 is rotated in an appropriate direction to displace the support member 12 by a distance "d" estimated or determined to be appropriate to adjust the screed extension 4 to a desired angle of attack $\alpha_e$. The movement of the support members 12 moves the attached screed extension 4 generally toward or away from the front surface 3*b* of the main screed 3. As is apparent with the preferred structure of the screed assembly 10, a screed extension 4 may only displace toward the main screed 3 if the extension 4 had already been previously displaced from the main screed 3. In either case, movement of the extensions 4 causes the above-described screed extension pivot points P to displace correspondingly toward or away from the main screed 3 by the same distance d, thereby affecting the screed extension angle of attack $\alpha_e$ as follows.

When the screed assembly 10 is moving forwardly (in direction 11) during a paving operation, paving material resists the forward motion of the screed extensions 4 (and also the main screed 3). If the screed extensions 4 are arranged such that the rear surface 4*b* of a screed extension 4 is generally disposed against the front surface 3*b* of the main screed (FIG. 3), the screed extensions 4 are supported by the main screed 3 and the screed extensions 4 have substantially the same angle of attack $\alpha$ as the main screed 3. If the screed extensions 4 have been displaced away from the main screed 3, the resistance of paving material pushes the screed extensions 4 such that the each extension 4 rotates rearwardly about the pivot points P until a lower portion of the screed extension rear surface 4*b* contacts the front surface 3*b* of the main screed 3 at about a point C.

As indicated in FIG. 8, the rearward rotation of a screed extension 4 about the pivot points P adjusts the angle of attack $\alpha_e$ of the screed extension 4 to be of a lesser value than the angle of attack $\alpha_m$ of the main screed 3, such that a relative angle $\beta$ exists between the respective angles of attack. The difference between the angles of attack, the angle $\beta$, may be increased by moving the screed extension 4 further away from the main screed 3 or decreased by moving the screed extension 4 toward the main screed front surface 3*b*, in each case by appropriate displacement of the support members 12. Generally, both of the screed extensions 4 are adjusted to the same angle of attack $\alpha_e$ as the other screed extension 4. However, in certain operating conditions, such as for example paving on a banked, curved surface, the screed extensions 4 may be adjusted so that each has a different angle of attack $\alpha_e$ than the other.

The improved screed assembly 10 of the present invention is clearly advantageous over previously known screed assemblies. By having the movable support members 12, and also preferably the adjustment devices 14, the angle of attack $\alpha_e$ of the screed extensions may be adjusted as described above to improve the characteristics of a mat of paving material leveled thereby. Further, by re-working the support members 12 of an existing known screed assembly and preferably adding the adjustment members 14 to the assembly, existing screed assemblies may be upgraded to be capable of functioning in accordance with the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A screed assembly for use in paving material upon a generally horizontal surface, the screed assembly comprising:

a main screed having a generally vertical front surface;

a screed extension connected with the main screed; and a horizontally-extending support member having a first end movably connected with the main screed and a second end connected with the screed extension and movable with respect to the main screed so as to displace the screed extension alternately toward and away from the main screed front surface.

2. The screed assembly as recited in claim 1 wherein the screed extension has a generally horizontal working surface and movement of the support member adjusts an angle between the screed extension working surface and the base surface.

3. The screed assembly as recited in claim 1 wherein the main screed has a generally horizontal working surface, the screed extension has a generally horizontal working surface and movement of the support member adjusts an angle between the screed extension working surface and the main screed working surface.

4. The screed assembly as recited in claim 1 further comprising an adjustment assembly connected with the support member and configured to displace the support member with respect to the main screed.

5. The screed assembly as recited in claim 4 wherein the adjustment assembly includes:

a first member attached to one of the main screed and the support member; and a second member having a first end attached to the other of the main screed and the support member and a second end movably engaged with the first member such that the second member is displaceable with respect to the first member to displace the support member with respect to the main screed.

6. The screed assembly as recited in claim 5 wherein:

the first adjustment member has a threaded hole; and the second adjustment member is a rod having a threaded portion engaged with the threaded hole of the first adjustment member such that rotation of the rod moves the screed extension with respect to the main screed.

7. The screed assembly as recited in claim 6 wherein rotation of the rod in a first direction moves the screed extension away from the main screed and rotation of the rod in a second direction moves the screed extension toward the main screed.

8. The screed assembly as recited in claim 1 further comprising another support member extending between the main screed and the screed extension, the two support members being spaced laterally along the main screed.

9. The screed assembly as recited in claim 1 wherein the main screed has first and second ends, the screed extension being disposed proximal to the first end, and the screed assembly further comprises:

another screed extension disposed proximal to the second end of the main screed, the two screed extensions being spaced laterally along the main screed;

another horizontally-extending support member having a first end connected with the main screed and a second end connected with the other screed extension and movable with respect to the main frame so as to displace the other screed extension alternately toward and away from the main screed front surface.

10. An adjustment device for varying the angle of attack of a screed assembly for paving material upon a generally horizontal surface, the screed assembly including a main screed, a screed extension connected with the main screed, and a horizontally-extending support member having a first end connected with the main screed and a second end connected with the screed extension, the adjustment device comprising:

a base attached to one of the main screed and the support member; and a horizontally-extending rod having a first end attached to the other of the main screed and the support member and a second end movably engaged with the base such that movement of the rod with respect to the base displaces the screed extension one of toward and away from the front surface of the main screed so as to adjust the angle of attack of the screed extension.

11. The adjustment device as recited in claim 10 wherein:

the base has a threaded hole; and the rod has a threaded portion rotatably engaged with the threaded hole of the first adjustment member such that rotation of the rod moves the screed extension with respect to the main screed.

12. The adjustment device as recited in claim 11 wherein rotation of the rod in a first direction moves the screed extension away from the main screed and rotation of the rod in a second direction moves the screed extension toward the main screed.

13. The adjustment device as recited in claim 10 wherein the main screed has a generally horizontal working surface, the screed extension has a generally horizontal working surface and displacement of the movable member adjusts an angle between the screed extension working surface and the main screed working surface.

14. A screed assembly for use in paving material upon generally horizontal surface, the screed assembly comprising:

a main screed having a generally vertical front surface;

a screed extension connected with the main screed;

a support member having a first end connected with the main screed and a second end connected with the screed extension and extending generally perpendicularly with respect to the front surface of the main screed; and an adjustment assembly connected with the support member and configured to displace the support member with respect to the main screed so as to move the screed extension alternately toward and away from the front surface of the main screed.

15. The screed assembly as recited in claim 14 wherein the adjustment assembly includes:

a first member attached to one of the main screed and the support member; and a horizontally-extending second member having a first end attached to the other of the main screed and the support member and a second end movably engaged with the first member such that movement of the movable member with respect to the first member displaces the screed extension one of toward and away from the front surface of the main screed.

16. The screed assembly as recited in claim 15 wherein:

the first member has a threaded hole; and the second, movable member is a rod having a threaded portion engaged with the threaded hole of the first member such that rotation of the rod moves the screed extension with respect to the main screed.

17. The screed assembly as recited in claim 16 wherein rotation of the rod in a first direction moves the screed extension away from the main screed and rotation of the rod in a second direction moves the screed extension toward the main screed.

18. The screed assembly as recited in claim 14 wherein the screed extension has a generally horizontal working surface and movement of the support member adjusts an angle between the screed extension working surface and the base surface.

19. The screed assembly as recited in claim 14 wherein the main screed has a generally horizontal working surface, the screed extension has a generally horizontal working surface and movement of the support member adjusts an angle between the screed extension working surface and the main screed working surface.

20. The screed assembly as recited in claim 14 further comprising another support member extending between the main screed and the screed extension, the two support members being spaced laterally along the main screed.

* * * * *